United States Patent [19]

Cordray

[11] Patent Number: 4,854,837

[45] Date of Patent: Aug. 8, 1989

[54] ROTARY ACTUATED PUMP OR MOTOR

[75] Inventor: Robert K. Cordray, Broomfield, Colo.

[73] Assignee: Cordray International Corporation, Broomfield, Colo.

[21] Appl. No.: 97,542

[22] Filed: Sep. 15, 1987

[51] Int. Cl.[4] ..... F04B 7/06; F04B 39/10

[52] U.S. Cl. ..... 417/492; 417/500; 418/68

[58] Field of Search ..... 418/68, 182; 417/492, 417/500; 91/233; 123/45 A, 46 A

[56] References Cited

U.S. PATENT DOCUMENTS

| | | | |
|---|---|---|---|
| 908,916 | 1/1909 | Weinat | 418/68 |
| 1,229,590 | 6/1917 | Dawe | 418/68 |
| 3,697,201 | 10/1972 | Eickmann | 418/182 |
| 4,067,668 | 1/1978 | Nimell | 418/68 |

FOREIGN PATENT DOCUMENTS

| | | | |
|---|---|---|---|
| 693534 | 8/1930 | France | 418/68 |
| 58-206801 | 12/1983 | Japan | 418/68 |
| 514628 | 11/1939 | United Kingdom | 418/68 |
| 597743 | 2/1948 | United Kingdom | 418/68 |

*Primary Examiner*—John J. Vrablik

*Attorney, Agent, or Firm*—Donald W. Margolis; John L. Isaac

[57] ABSTRACT

A rotary pump or motor is disclosed which includes a housing which defines a substantially cylindrical cavity having a central axis. A pair of stators are secured at each end of the cylindrical cavity and each stator has a cam surface defined by at least a pair of surface peaks circumferentially alternating with at least a pair of surface valleys, the stator cam surfaces being spaced apart and opposed to one another. A substantially cylindrical rotor having length and diameter dimensions is disposed for rotation within the cavity between the stators. The rotor includes first and second end cam surfaces configured for mating engagement with adjacent stator cam surfaces. Each rotor end face is a cam surface defined by at least a pair of surface peaks circumferentially alternating with at least a pair of surface valleys. A shaft is connected to the rotor for rotation therewith within the cavity while permitting axial movement between the shaft and the rotor. The rotor is spaced between the stators so as to reciprocate along the shaft between alternate mating engagement with each stator cam surface to define at least a pair of chambers between the rotor and each stator. Finally, a port mechanism is disposed in the housing to control the intake and discharge of fluid from the pair of chambers defined on each side of the rotor, the reciprocating rotor opening and closing the chambers and the port mechanism as it rotates and reciprocates within the cavity.

29 Claims, 3 Drawing Sheets

ROTARY ACTUATED PUMP OR MOTOR

BACKGROUND OF THE INVENTION (a) Field of the Invention

The present invention relates to positive displacement pumps or motors and, more particularly, to rotary actuated pumps and motors. More specifically, the present invention relates to a rotary pump or motor having a single rotary element designed to form fluid displacement chambers as well as to serve as a rotary valve control.

(b) Description of the Prior Art

Rotary motors or engines having rotary piston members are well known in the ar. Examples of such known devices are illustrated in U.S. Pat. Nos. 659,675; 676,897; 686,8O9 and 1,114,132. Motors and pump devices wherein a rotor having cam surfaces is involved in the displacement of fluid are illustrated in U.S. Pat. Nos. 205,868; 2,896,590; 3,129,669; 3,319,615; 3,525,216 and 4,605,361. However, in each of these prior art embodiments, multiple rotating elements are utilized, often with complex camming arrangements. These complex devices result in multiple wearing surfaces which increase the cost of maintenance. They also require complex mechanical interaction which require complicated timing arrangements and other related complications. The cost of original construction is also high for such complex devices. Moreover, in most of these devices, the camming rotor is not utilized for the purpose of directly forming fluid displacement chambers. Consequently, there is no currently known positive displacement pump or motor which is simple in design and construction, capable of small size construction, limited in mechanical complexity, and yet large in flow rate or displacement relative to its size.

SUMMARY OF THE INVENTION

Accordingly, it is one object of the present invention to provide a high performance and high capacity rotary pump or motor having limited moving mechanical portions.

It is another object of the present invention to provide a rotary pump or motor having an improved design wherein a single rotor element functions as a rotary valve controlling inlet and outlet ports from multiple fluid displacement chambers.

A further object of the present invention is to provide a pump or motor of the foregoing description which is very compact relative to its flow rate or displacement, capable of moving large volumes of fluids at high pressure, which is mechanically efficient, economical to construct and operate, and reliable in operation.

Yet another object of the present invention is to provide a rotary pump and motor having an improved cam drive mechanism utilizing only one rotational element which operates in conjunction with a porting arrangement such that all the ports in the same cycle, intake or discharge, are interconnected thereby providing simplicity of design and operation.

In accordance with the above and other objects and advantages of the present invention, a rotary pump or motor is provided which includes a housing which defines a substantially cylindrical cavity having a central axis. A pair of stators are non-rotatably secured at each end of the cylindrical cavity. Each stator has a cam surface defined by at least a pair of surface peaks circumferentially alternated with at least a pair of surface valleys. The stator cam surfaces are spaced apart and opposed to one another on opposite sides of the central cavity. A substantially cylindrical rotor having a length dimension and a diameter is also provided and is disposed for rotation within the central cavity between the stators. The rotor includes first and second substantially symmetrical end cam surfaces configured, when in one position, for mating engagement with one or the other of the adjacently disposed stator cam surfaces. Each rotor end cam surface includes at least a pair of surface peaks circumferentially alternated with a at least a pair of surface alleys.

A shaft member is connected to the rotor for rotation therewith within the cavity while permitting axial movement between the shaft and the rotor. The rotor is spaced between the stators so as to reciprocate along the shaft between alternate mating engagement with each stator cam surface to alternately define a first and second chamber between each rotor end cam surface and each adjacent stator. Finally, a port mechanism is disposed in the housing to control intake and discharge of fluid from the pair of chambers defined on each side of the rotor, the reciprocating rotor opening and closing the chambers and the port mechanism as it rotates and reciprocates within the cavity.

For a fuller understanding of the nature and objects of the present invention, reference should be made to the following detailed description taken in conjunction with the accompanying drawings.

BRIEF DESCRIPTION OF THE DRAWINGS

The accompanying drawings which are incorporated herein and form a part of the specification, illustrate complete preferred embodiments of the present invention according to the best modes presently conceived for the practical application of the principles thereof, and, together with the specification and claims serve to explain the principles of the invention. In the drawings:

Figure 1:
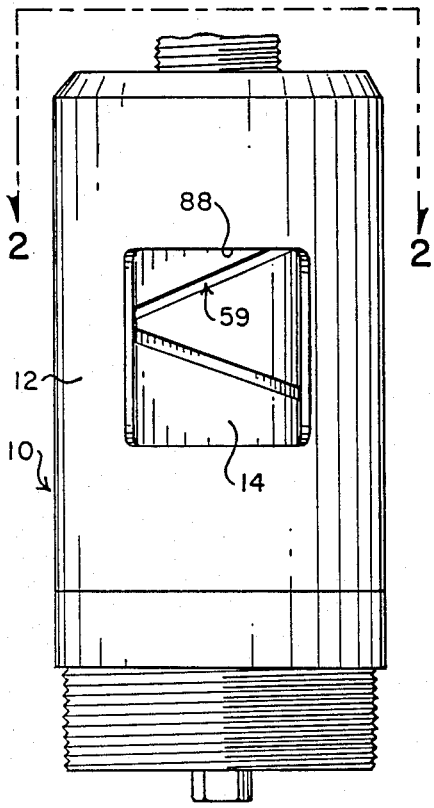
FIG. 1 is a front plan view of one embodiment of the rotary pump and motor of the present invention.

FIGS. *6a–6d* are generally a series of schematic front plan views illustrating the reciprocal movement of the rotor element as it rotates with the drive shaft relative to the stationary stators and the variations of the fluid displacement chambers therebetween;

FIGS. *7a–7d* are generally a series of fragmentary schematic front plan views, similar to that of FIG. 1, and illustrating the position of the rotary element within the housing relative to one inlet/outlet, and corresponding to the variations in position of the rotary element of FIGS. *6a–6d;*

Figure 8:
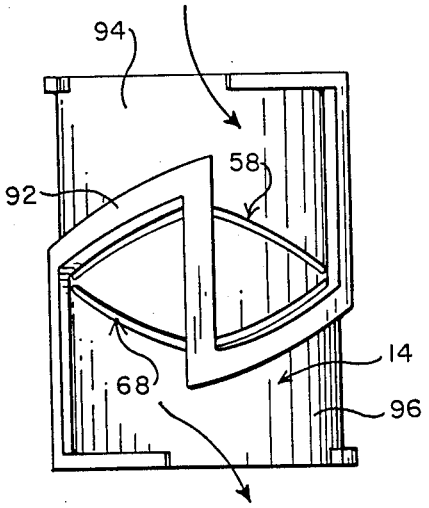
Figure 9:
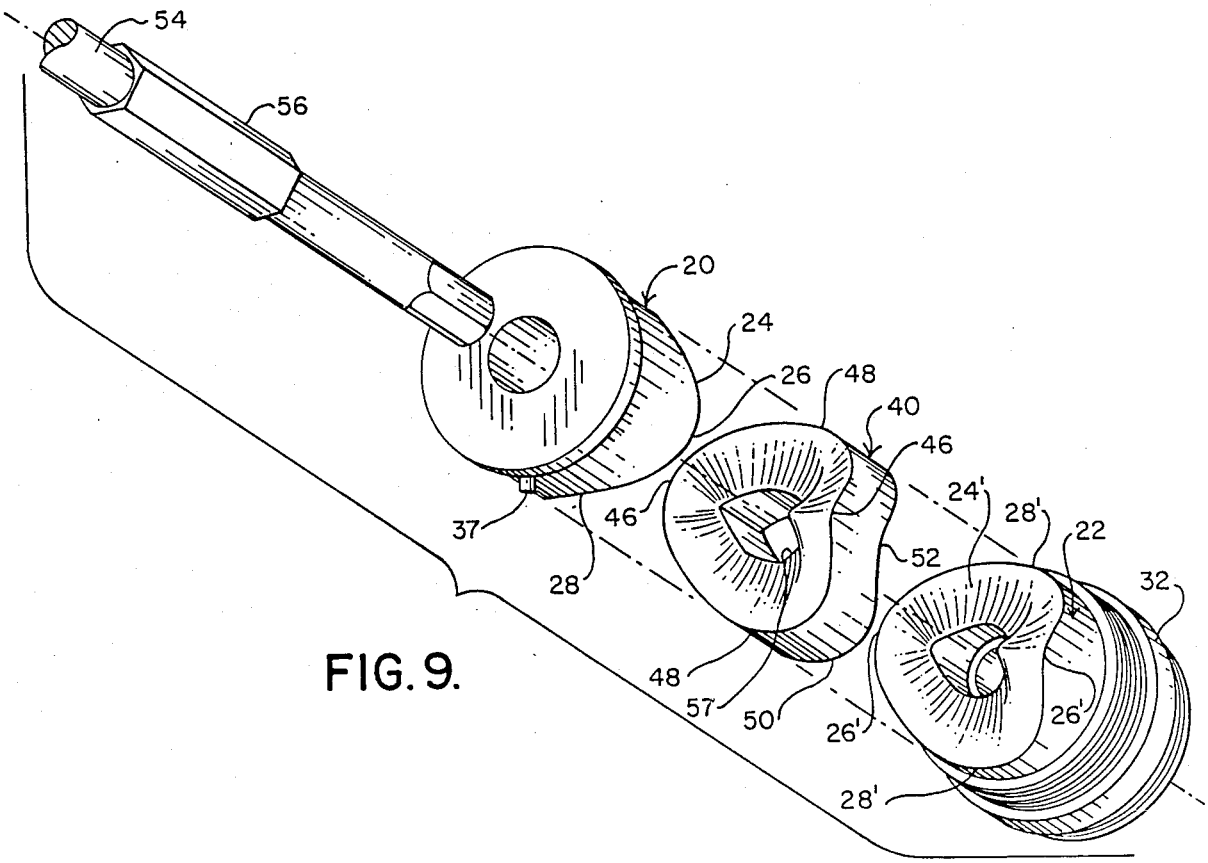

FIG. 8 illustrates a front plan view of an alternate embodiment of the invention which may be utilized to separate inlet and outlet ports to control fluid movement into and out of the pump or motor; and FIG. 9 is an isometric exploded view of the two stators, the rotor and the shaft which are used in the preferred practice of the present invention, including details of the cam surfaces.

DETAILED DESCRIPTION OF THE PREFERRED EMBODIMENTS

Figure 3:
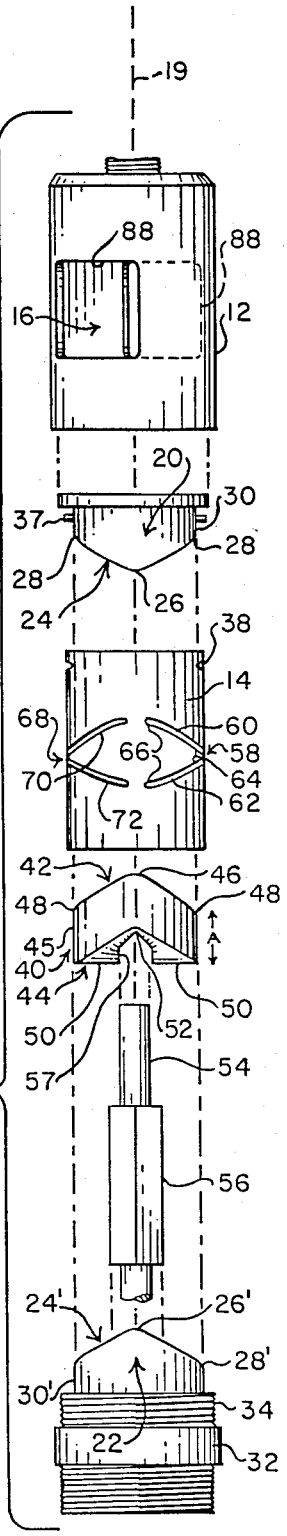
FIG. 3 is an exploded view rotated 30° of the embodiment illustrated in FIG. 1.
Figure 2:
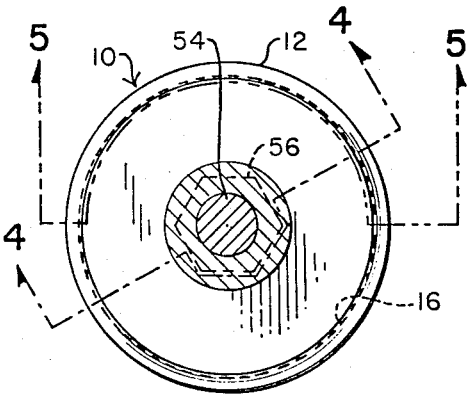
FIG. 2 is a top elevation view, with parts in phantom of the embodiment illustrated in FIG. 1.
Figure 5:
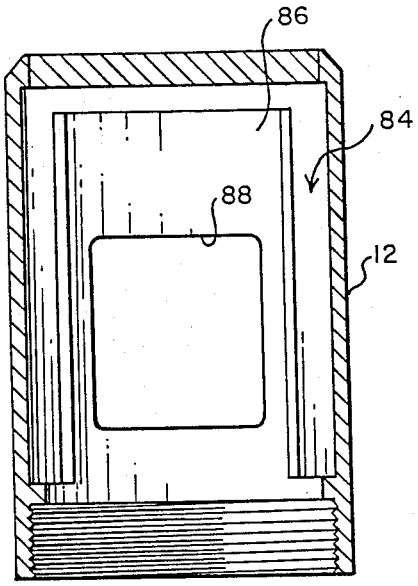
FIG. 5 is a cross-sectional view of the housing of the invention as taken substantially along line 5—5 in FIG. 2.

Referring initially to FIGS. 1 and 3, a rotary pump or motor system, generally 10, is disclosed. The system 10 is preferably used as a positive displacement pump and will be illustrated and discussed in detail in this capacity. However, it should be noted that the design of the present invention may, with immaterial modifications, function as a motor or as a compressor or as a 4-cycle engine. These modifications, which generally are directed to length of stroke and porting arrangements, will be discussed in further detail below.

Referring to FIGS. 1 and 3 again and the pump embodiment illustrated therein, a pump 10 preferably includes a cylindrical outer housing 12 in the form of a sleeve, and a cylindrical inner housing 14 spaced slightly radially inwardly within the outer housing 12. The inner housing 14 defines an inner cylindrical cavity 16 and an interior housing surface 17 and has a central axis 19. The spacing 18 between the inner and outer housings 14, 12 is utilized in conjunction with the porting of the pump 10 as discussed in greater detail below.

Figure 6D:
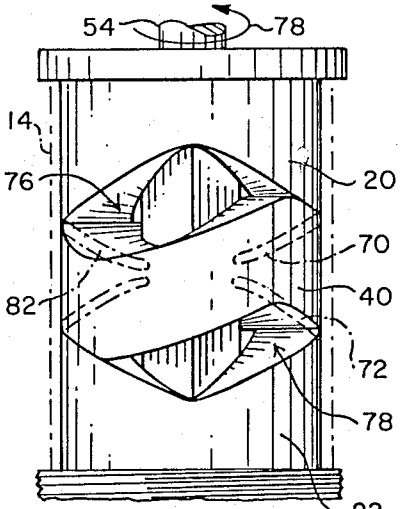
Figure 6C:
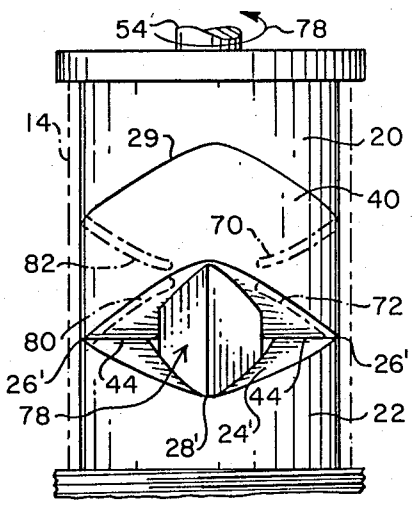
Figure 6B:
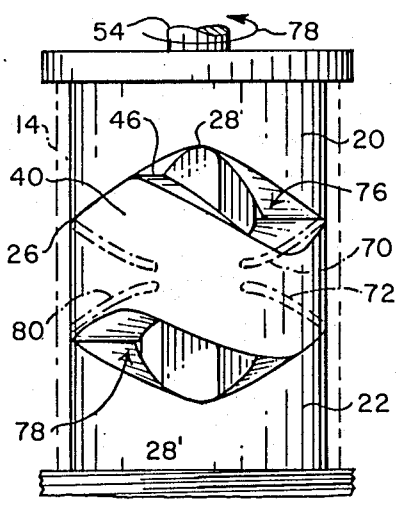
Figure 6A:
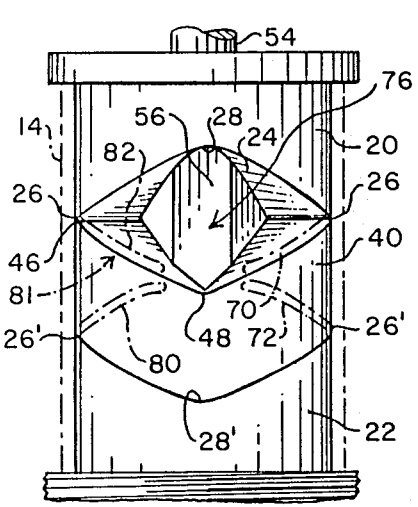
Figure 7D:
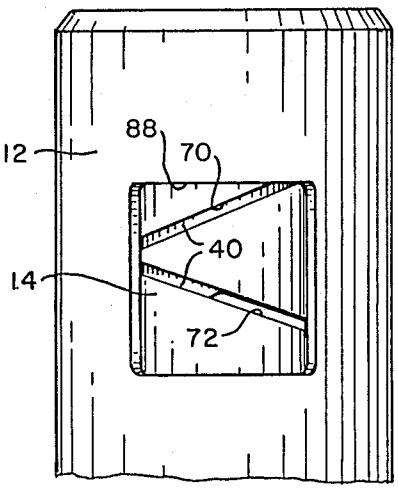
Figure 7C:
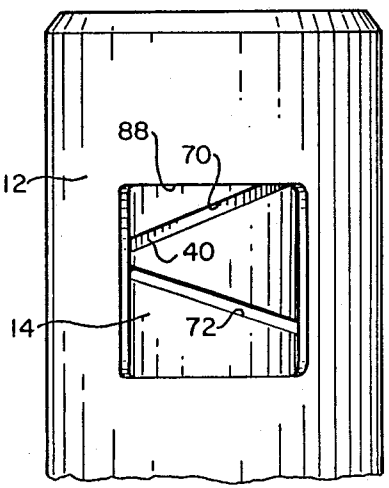
Figure 7B:
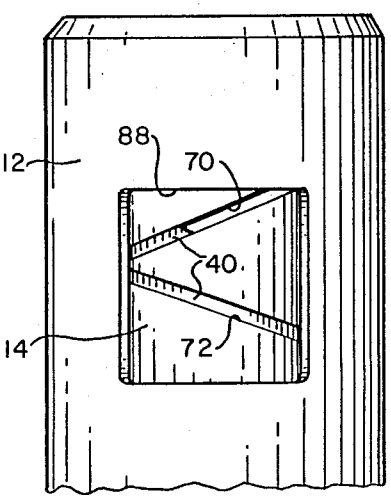
Figure 7A:
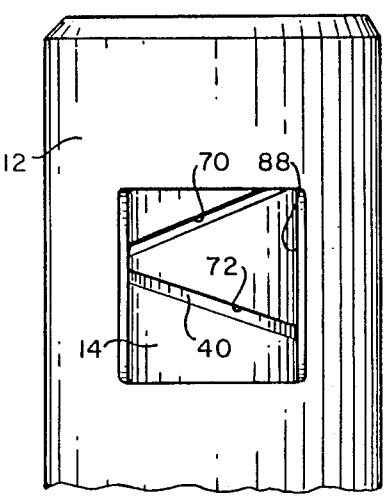

A pair of first and second stators 20 and 22, respectively, are secured at each end of the inner housing 14. Stators 20 and 22 can be mechanically linked to the inner housing 14 or can be integrally formed therewith, but in any event, stators 20 and 22 do not rotate, or in any other manner move. In its preferred form, and as more clearly illustrated in FIGS. 3, **6*a*–6*d*, and 9, the first stator 20 includes a circular cam surface 24 preferably defined by a pair of surface peaks 26 spaced diametrically opposite each other, and a pair of surface valleys 28 likewise spaced diametrically opposite each other. Surface valleys 28 are positioned circumferentially equidistantly between the surface peaks 26, and likewise, the surface peaks 26 are positioned circumferentially equidistantly between the surface valleys 28. In preferred embodiments the cam surface 24 is defined by a plurality of flat, normalized surfaces aligned obliquely to each other and extending between the surface peaks 26 and the surface valleys 28. The flat surfaces of cam 24 are thus defined by planes extending through peripheral helical lines 29 which interconnect alternating surface peaks and valleys, see FIGS. 6*c* and 9, adjacent helical lines being of alternate opposite hands. It should be noted that the normalized cam surfaces 24 are defined by the helical lines 29 along the outer surface 30 so as to form sharp apexes in the form of the surface peaks 26 and sharp oblique angles in the form of the surface valleys 28**. The sharp peak ends and sharp valley junctures are preferred so that the rotor may break away sharply and distinctly from one function to the next as described below.

In preferred form, the outer surface 30 of the stator 20 is generally cylindrical so as to securely and non-rotatably firmly fit against the interior annular surface 17 of the housing 14. In alternative embodiments, stator 20 may be integral with inner housing 14.

Now referring to the second stator 22, it should be noted that it is preferably formed in mirror image to the stator 20 so that it too includes a cam surface 24' having sharp surface peaks 26' and sharp obliquely angled surface valleys 28', the outer surface 30' being sized and shaped for secure non-rotatable engagement with the inner surface 17 of inner housing 14. In the illustrated form of FIGS. 1–5, the second stator 22 is a portion of removable housing base 32 which includes thread members 34 for threading engagement with thread members 36 carried on the inner end surface of the inner housing 14. A similar threading arrangement may be utilized with the stator 20 and the housing 14 or, as illustrated in FIG. 3, pins 37 may be utilized with stator 20 to engage apertures 38 in the end portion of the inner housing 14. It should be noted that any mechanism for securely and nonrotatably mounting the stators 20, 22 within the ends of the inner housing 14 may be utilized in accordance with the present invention.

Figure 4:
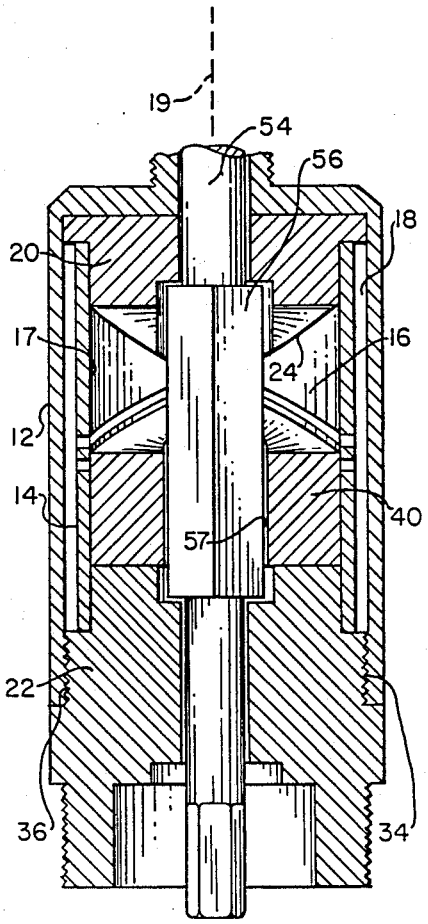
FIG. 4 is a cross-sectional view taken substantially along line 4—4 of FIG. 1.

A rotor element 40 is disposed within the cavity 16 positioned between the stators 20, 22. As best shown in FIGS. 3, 4, **6*a*–6*d* and 9, the rotor element 40 includes a first cam end surface 42, which is adjacent to cam surface 24 of first stator 20, a second cam end surface 44, which is adjacent to cam surface 24' of second stator 22, and a cylindrical outer surface 45 which firmly engages the inner cylindrical surface 17 of inner housing 14. End face 42 and end face 44 are symmetrical and, in one position, are sized and shaped for mating engagement with the cam surfaces 24, 24' of the stators 20, 22. More specifically, the first end face 42 includes a cam surface defined by a pair of diametrically opposed surface peaks 46 circumferentially alternated with a pair of diametrically opposed surface valleys 48. Surface peaks 46 are formed in a sharp apex by flat normalized surfaces, and the surface valleys 48 are formed at an oblique angle by the juncture of flat normalized surfaces. Thus, when the first end face 42 matingly engages the cam surface 24 of the stator 20, the surface peaks 46 of the first face 42 nest in the surface valleys 28 of the stator 20, while the surface valleys 48 of the first face 42 nest against the surface peaks 26 of the stator 20. In this form, the first face 42 of rotor 40 firmly abuts the cam surface 24 of first stator 20**.

The second end face 44 of the rotor 40 is substantially symmetrical with the camming surface of the first end face 42. Thus, the camming surface of the second end face 44 includes a pair of diametrically disposed surface peaks 50 which are axially aligned with the surface valleys 48 of the first end face 42, and a pair of diametrically disposed surface valleys 52 which are circumferentially spaced equidistantly from the surface peaks 50 and are also axially aligned with the surface peaks 46 of the first end face 42. In preferred forms, the length dimension A of the rotor 40 is substantially uniform throughout the entire rotor 40. In operation, distance between the stators 20, 22 and the length dimension A of the rotor 40 are such that when the first end face 42 of the rotor 40 is matingly engaged against the cam surface 24 of the stator 20 with peaks 46 of rotor 40 engaging valleys 28 of first stator 20 and with valleys 48 being engaged by peaks 26 of first stator 20, the surface peaks 50 of the second end face 44 of rotor 40 abut the surface peaks 26' of the stator 22 so as to create a pair of chambers defined o either side of the abutting surface peaks 50 and 26' of the rotor 40 and the stator 22.

When used as a pump, the rotor 40 may be rotated by a drive shaft 54 which is disposed along the central axis 19 of the device 10. The drive shaft 54 includes a mechanism for securing the rotor 40 for rotation therewith, the drive shaft 54 being freely rotatable within the stationary stators 20 and 22. Thus, as the shaft 54 is caused to rotate, the rotor 40 rotates with it; and in a similar manner, when rotor 40 is caused to rotate the shaft 54 rotates with it. However, the rotor 40 is secured to the drive shaft 54, in such a manner as to allow the rotor 40 to move axially relative to the drive shaft 54 as it rotates so that it may reciprocate between mating engagement of the first end cam surface 42 and the cam surface 24 of the first stator 20, as discussed above, and mating engagement between the second end cam surface 44 and the cam surface 24' of the second stator 22. In this latter instance, when the second end cam surface 44 is matingly engaged with the cam surface 24' of the stator 22, the surface peaks 46 of the first end face 42 abut the surface peaks 26 of the stator cam surface 24 so as to form a second pair of chambers on either side of the abutting surface peaks 26 and 46 between the first face 42 of rotor 40 and the cam surface 24 of first stator 20. As a result of the above configuration, when the rotor 40 rotates it reciprocates back and forth between the stators 20, 22 so as to form alternate pairs of chambers between the rotor 40 and the stator 22 and the rotor 40 and the stator 20.

A preferred mechanism for securing the rotor 40 to the drive shaft 54 while permitting the reciprocating movement along its length is to form the drive shaft 54 with a central portion 56 having at least one flat surface along the circumference thereof. Preferably, this central portion 56 is polygonal in shape along the circumferential surface, for example hexagonal, as shown. The rotor 40 has a central aperture 57 which receives the central portion 56 of shaft 54. Central aperture 57 should likewise be formed polygonal in shape along its inner surface, so as to require the rotor 40 to rotate with the drive shaft while allowing the rotor 40 to move axially along the central portion 56, of shaft 54.

The inner housing 14 preferably includes a plurality of inlet and outlet ports in the circumferential outer surface thereof which are designed and located to interface with the chambers formed within the cavity 16 by the rotating and reciprocating action of the rotor 40. Formation of these chambers can be more readily seen in FIGS. *6a–6d* and there coordinated interaction with the ports is shown in FIGS. *7a–7d*, and will be described in greater detail below. Referring to FIG. 3 and FIGS. *7a–7d*, eight helical slots 59 are preferably formed in the circumferential wall of the inner housing 14, which slots 59 function as ports. In the preferred form, the ports are arranged in four sets having two pair of ports per set. As illustrated in FIG. 3, a first set of ports 58 includes an upper slot 60 axially positioned toward the stator 20, and a lower slot 62 aligned or positioned toward the stator 22. The slots 60 and 62 are helically shaped so as to obliquely angle toward each other at one end 64 and away from each other at the opposite ends 66, thus being of opposite hand. A second set of ports 68 are aligned the exact opposite of the first set of ports 58 so that an upper port 70 axially positioned toward the stator 20 is obliquely oriented relative to a lower port 72 axially positioned toward the stator 22. This pattern is repeated, not shown, on the opposite side of the housing 14, thereby creating four upper ports associated with the chambers formed between the rotor 40 and the stator 20, and four lower ports circumferentially spaced about the housing 14 associated with the lower chambers formed between the rotor 40 and the stator 22. Each set of axially aligned ports, such as set 58 comprising the ports 60 and 62, are associated with the same function, that is either discharge from or input of fluid from an upper and a lower chamber. The circumferentially adjacent sets of ports on either side thereof, say set 68 comprising the ports 70 and 72, are associated with the opposite function, as more clearly described in FIGS. *6a–6d* and *7a–7d*.

Referring now to FIGS. 6 and 7, FIG. *6a* illustrates the rotor 40 in mating engagement with the lower stator 22. In this instance, the surface peaks 46 of the first end rotor cam surface 42 are abutting the surface peaks 26 of the cam surface 24 on the first stator 20 so as to create a pair of upper chambers 76, only one of which is viewable in FIG. *6a*. In the configuration illustrated in FIG. *6a* there are no lower chambers. As the rotor 40 and shaft 54 rotates in the counterclockwise direction indicated by the arrow 77, the surface peaks 46 moves out of engagement with the surface peaks 26 and move toward the surface valleys 28 of the cam surface 24 of stator 20. As this occurs, the chamber 76 is diminished in size so as to press fluid therefrom through the port 70. Simultaneously, the lower chambers 78, of which only one is viewable in FIGS. *6b* and *6d*, are being created and draw fluid in through a lower port 80 of an adjacent set 81 of ports. As the rotor 40 completes 90° of rotation, as shown in FIG. *6c*, the upper chambers 76 have been totally eliminated and the fluid therein having been discharged through the port 70, while the lower chamber 78 is at its maximum size having been filled through the port 80. In the configuration shown in FIG. *6c* the surface peaks 50 of the second end rotor cam surface 44 are abutting the surface peaks 26' of the cam surface 24' on the second stator 22. As the rotor 40 continues its counterclockwise rotation a illustrated in FIG. *6d*, the lower chamber 78 will begin to reduced in size with the fluid therein being expelled through the lower port 72 while a new chamber 76 is created and filled through the port 82. Thus, the upper and lower ports 70, 72 of this particular set of ports 68 serve as a discharge function, while the set of ports 81 adjacent thereto, as represented by the ports 80 and 82, serve as inlet ports to the chambers 76 and 78 as the rotor 40 continues its counterclockwise rotation and reciprocating movement between the fixed stators 20, 22.

In a preferred embodiment, all the inlet ports are linked together through a common fluid inlet of the device 10, and all the outlet ports are linked together through a common fluid outlet. This can be accomplished in a variety of ways. In the embodiment illustrated in FIGS. 1–5, FIG. 5 illustrates one mechanism for coordinating and linking common porting functions. In this embodiment, the inner surface 84 of the outer cylinder 12 includes a radially inwardly raised portion 86 which surrounds an opening 88 in the wall of the housing 12. A pair of openings 88 are disposed opposite each other in the wall of the housing 12, with each opening 88 permitting access to one set of ports, such as a set of ports 68. This is clearly illustrated in FIGS. *7a–7d*. This arrangement is repeated on the opposite side of the housing 12 so that two pairs of ports open directly to the exterior of the outer housing 12. The raised portion 86 on the inner surface 84 of the housing 12 contacts the inner housing 14 and seals the remaining two sets of ports from the apertures 88. In this manner, fluid flowing into or out of these sealed ports is directed through an external aperture, not shown, which is in fluid communication with the space 18, shown in FIG. 4, between the inner and outer housings 12 and 14, respectively. This arrangement permits, for example, the pump 10 to be placed in contact with a fluid at one port 88 for the purpose of pumping the fluid through the opposite port 88. In this example, then, the ports having access to the fluid through one opening 88 function as a fluid inlet port, while the other port functions as an exit port, thereby allowing the pump 10 to direct fluid through the pump 10 at one opening 88 and discharge it through the other opening 88.

Another embodiment which links inlet and outlet ports together is illustrated in FIG. 8. In this instance, a raised surface 92 is disposed along the outer surface of the inner housing 14 so as to create a first channel 94 interconnecting one set of ports 58 with its radially oppositely disposed set of ports having a similar inlet or outlet function, and a second channel 96 interconnecting a second set of ports 68 with its radially oppositely disposed ports having also a similar function. In this instance, the inner surface 84 of the outer housing 12 is cylindrical and smooth in shape so as to firmly contact the outer surface of the raised portions 92, thereby creating the channels 94 and 96. In the illustrated example, the channels 94 are directed to a singular inlet opening disposed at the upper end of the pump 10, while the channel 96 is directed to a singular outlet opening at the lower end of the pump 10. It should be recognized, however, that any mechanism for interconnecting sets of ports having the same function may be utilized so that there is preferably a singular inlet and a singular outlet to enhance the simplicity and efficiency of the pump or motor of the present invention.

The pump or motor 10 of the present invention may be readily reversed so as to reverse the flow of fluid through the pump 10 merely by rotating the shaft 54 and the rotor 40 in an opposite direction. Thus, inlet and outlet functions may be changed almost immediately just by changing the direction of rotor rotation. Maximizing the bearing surface across the width of the rotor 40 is also readily achievable with the present invention, rather than relying on mere contact of the rotor's outer edges as is the case of many rotor elements of prior devices. To achieve this maximum bearing surface, the cam surfaces of the rotor 40 and the stators 20, 22 are preferably digitally machined to normalize the surfaces, thereby obtaining full bearing surfaces against one another. Firm sealing between the chambers 76 and 78 created by rotation and reciprocation of the rotor 40 is precisely maintained due to such normalization as the rotor 40 acts as a rotary valve to open and close the ports located in the wall of the inner housing 14.

It should be noted that the shape and spacing of the helical slot ports 59 in the housing 14 are dictated by the length of the reciprocal stroke of the rotor 40 as it makes one complete cycle. Moreover, the angle of the ports relative to the axis 19 is directly dependent upon the obliqueness or steepness of the cam surfaces of the rotor 40 and the stators 20, 22 relative to the axis 19. This obliqueness or steepness will also determine, in part, the stroke length of the rotor 40. While this angle may vary depending upon the end needs of the pump 10, an angle of 50°–70° relative to the central axis 19 is preferred. Moreover, the size of the ports in the housing 14 can be altered for different flow characteristics from the pump 10 depending on the desired end needs. This makes for a very compact pump relative to its flow rate or displacement while having only two moving parts, that of the rotor and the drive shaft. If the upper and lower ports of each set of ports are not linked together as described above, but rather are kept separate, this porting arrangement permits the device 10 to simultaneously move two fluids using only one pump.

The pump 10 as described above can be configured somewhat differently to convert it to a motor. When the pump 10 is configured with a long stroke length for the rotor 40, and when the rotor 40 is constructed from low friction material, such as Teflon plastic or the like, the device 10 can function as a pneumatic or hydraulic pump or motor by applying fluid pressure to the fluid inlet ports. The fluid can be either a gas or a liquid. Moreover, several of these pumps or motors 10 can be positioned in series so as to add the total outlet pressures. By adding a pressure seal to separate the two chambers formed by the rotor and the stator on the same side of the rotor and removing some of the ports, a complete four-cycle internal combustion engine mechanism can be produced from the device 10. Furthermore, multiple rotor stages can be added to the pump 10 with the rotors working in opposition to each other, and in this way inertial loading and vibration can be cancelled. Moreover, these stages can be intentionally slightly set out of phase to allow the device to be a self-starting motor. Yet another alternate embodiment of the invention includes replacing the slot-shaped helical outlet ports with semi-circular ports. Such semi-circular port would be shaped and arranged relative to the configuration of the rotor so that they instantly open and close. This permits the device 10 to function as a fluid compressor which can be set for a pre-established pressure before the ports instantaneously open. This slight modification is simply a matter of appropriate shape and placement of the ports in the wall of inner housing 14.

As can be seen from the above, the present invention provides a simple and economical device for moving fluids which is limited to only two moving parts and is based on the operation of using symmetrical cam surfaces. The cam surfaces are preferably normalized to provide maximum bearing surface and are designed to end in abrupt, sharp surface peaks and surface valleys. These features ensure that the rotor sharply and quickly breaks away from one function to the next while maintaining a firm seal between chambers formed between the rotor and stationary stators. Due to the simplicity of the construction of invention, the device of the invention it is not only economical to manufacture, but has fewer wear points and therefore longer life. Moreover, when parts do become worn, it is a simple matter of merely replacing a rotor member or stator member quickly and efficiently with minimum down time. The device of the present invention can be constructed relatively small in size yet have a substantially large flow volume rate. Finally, the pump or motor of the invention is readily reversible merely by reversing the direction of rotation of the central rotor. The compact, space-efficient design of the present invention enables it to be capable of moving large volumes of fluid at high pressure while being economical to construct and operate.

While the invention has been particularly shown, described and illustrated in detail with reference to preferred embodiments and modifications thereof, it should be understood by those skilled in the art that the foregoing and other modifications are exemplary only, and that equivalent changes in form and detail may be made therein without departing from the spirit and scope of the invention as claimed, except as precluded by the prior art.

The embodiments of the invention for which an exclusive privilege and property is claimed are defined as follows:

1. The rotary pump or motor comprising:

housing means having an inner housing which defines a substantially cylindrical cavity having central axis, and an outer housing enclosing said inner housing;

a pair of coaxial stators disposed at each end of said inner housing to enclose said cavity, each said stator having a cam surface with said cam surfaces of said stators being spaced apart and opposed to one another;

a rotor having a length and diameter dimensions disposed for rotation within said cavity between said stators, said rotor including first and second substantially symmetrical end faces configured for mating engagement with oppositely disposed stator cam surfaces;

shaft means connected to said rotor for rotation therewith within said cavity while permitting axial movement between said shaft means and said rotor, said rotor being spaced between said stators to reciprocate along said shaft means between alternating mating engagement with each said stator cam surface during rotation of said rotor to define a pair of chambers between said rotor and each said stator; and port means disposed in said inner housing to control the intake and discharge of fluid from said pair of chambers defined on each side of said rotor, said reciprocating rotor opening and closing said chambers and said port means as it rotates and reciprocates within said cavity; and wherein further, said ports means comprises a plurality of paired helical slots disposed in said wall of said inner housing, said helical slots being sized and shaped so that as said rotor rotates and reciprocates within said cavity, said rotor functions as a rotary valve that opens and closes said helical slot ports, and with each said chamber being interconnected with a pair of helical slot ports based circumferentially adjacent each other and being of opposite hand with respect to each other.

2. The rotary pump or motor as claimed in claim 1, wherein said cam surface of each said stator and the cam surface of each rotor end face each includes at least a pair of surface peaks circumferentially alternated with at least a pair of surface valleys so as to form at least four obliquely intersecting surfaces.

3. The rotary pump or motor as claimed in claim 2, wherein said surface peaks and said surface valleys of each said stator cam surface and each said rotor end face are spaced substantially equidistant about said circumference of said stator cam surface and said rotor end face, said cam surfaces of said oppositely disposed stators being mirror images of each other such that substantially symmetrical rotor end faces may matingly engage only one stator cam surface at a time.

4. The rotary pump or motor as claimed in claim 3, wherein said stators and rotors are coaxial, and said stator is of substantially uniform depth.

5. The rotary pump or motor as claimed in claim 4, wherein each of said cam surfaces is normalized to provide complete mating engagement and a broad camming end surface.

6. The rotary pump or motor as claimed in claim 2, wherein said shaft means comprises a singular shaft aligned along said central axis of said cavity, said shaft including means for attachment to said rotor to permit said rotor to rotate therewith while simultaneously allowing said rotor to freely move along the axial length thereof.

7. The rotary pump or motor as claimed in claim 2, wherein the spacing between said stators and the length dimension of said rotor are sized such that when said first end face of said rotor is matingly engaged with said cam surface of said stator opposite thereof, said surface peaks of said second end face of said rotor abut said surface peaks of its opposed stator cam surface to form first and second chambers therebetween, and when second end face is matingly engaged with said cam surface of said stator opposite thereof, said surface peaks of said first end surface abut said surface peaks of its opposite stator cam surface to form third and fourth chambers therebetween, and wherein said port means are sized and positioned so that as fluid enters said first and second chambers, fluid is simultaneously exiting said third and fourth chambers, and that as fluid is entering said third and fourth chambers, fluid is simultaneously exiting said first and second chambers, in continuous alternating fashion, so that as said rotor rotates, fluid is constantly entering into and simultaneously being discharged from said inner housing cavity.

8. The rotary pump or motor as claimed in claim 1, wherein each member of said pair of said helical slot ports functions as an inlet port while its opposite member functions as an outlet port, said inlet helical slot ports of said first and second chambers being axially disposed adjacent said inlet helical slot ports of said third and fourth chambers, and wherein said outlet helical slot ports of said first and second chambers are axially aligned adjacent said outlet helical slot ports of said third and fourth chambers.

9. The rotary pump or motor as claimed in claim 8, wherein said pump or motor further includes means disposed between said inner and outer housings to channel all of the fluid from said outlet helical slot ports to a singular outlet means, and means for channeling fluid to said inlet helical slot ports from a singular inlet means.

10. In a rotary device for moving fluid having a housing, defining a substantially cylindrical cavity having a central axis, at least one rotary member disposed for rotary movement within said housing, shaft means positioned for rotating said rotary element, at least one fluid chamber within said housing, and port means for controlling the inlet and discharge of fluid from said at least one chamber in conjunction with movement of the at least one rotary element, the improvement comprising;

a pair of stators secured at each end of said housing cylindrical cavity, each said stator having a cam surface with said cam surfaces of said stators facing each other;

a rotor element having a depth and width dimensions disposed for rotation within said cavity between said stator, said rotor including first and second substantially symmetrical end faces configured for mating engagement with oppositely disposed surfaces such that when one said end face is matingly engaged with its opposite stator cam surface, said other rotor end face is a mirror image of its opposite stator cam surface and forms a pair of fluid chambers therebetween;

shaft means connected to said rotor for rotation therewith within said cavity while permitting axial movement between said shaft means and said rotor, said rotor being spaced between said stators to reciprocate along said shaft means between alternate mating engagement with each said stator cam surface during rotation of said rotor to define and alternately expand and contract a first pair of chambers disposed on one side of said rotor and a second pair of chambers disposed on the other side of said rotor between said rotor and each said stator; and port means controlling intake and discharge of fluid from said pair of chamber defined on each side of said rotor; wherein said port means comprises a plurality of helical slots disposed in said housing in size and shape so that as said rotor rotates and reciprocates within said cavity, said rotor functions as a rotary valve that opens and closes said helical slot ports, each said chamber being interconnected with a pair of helical slot ports spaced circumferentially adjacent each other and being of opposite hand with respect to each other.

11. The improvement as claimed in claim 10, wherein each cam surface of each said stator and each end face of said rotor is defined by at least a pair of cam surface peaks circumferentially alternated with at least a pair of cam surface valleys, said cam surfaces between such peaks and such valleys mean flat, normalized surfaces which intersects to create sharp pointed surface peaks and sharp, obliquely angled surface valleys.

12. The improvement as claimed in claim 11, wherein said improvement further includes said shaft means comprising a singular shaft aligned along said central axis of said cavity, said shaft including means for attachment to said rotor to permit said rotor to rotate therewith while simultaneously allowing said rotor to freely move in reciprocating fashion along the length thereof.

13. The improvement of claim 10, wherein said port means are sized and positioned so that as fluid enters said first pair of chambers disposed on one side of said rotor, fluid is simultaneously exiting said second pair of chambers disposed on the opposite side of said rotor, and that as fluid is entering said second pair of chambers, fluid is simultaneously exiting said first pair of chambers, in continuous alternating fashion, so that as said rotor rotates, fluid is constantly entering into and simultaneously being discharged from said device.

14. The improvement as claimed in claim 10, wherein the angle of said helical slot ports relative to the central axis of said housing is between 50°–70°.

15. The improvement of claim 10, wherein said device comprises a pneumatic or hydraulic motor, said rotor is constructed from low friction material, and inlet fluid to said device is directed to inlet ports under pressure

16. The improvement of claim 10, wherein said ports interconnecting said chambers on one side of said rotor are maintained separate from said ports interconnecting said ports on the opposite side of said rotor, whereby the device can simultaneously moving different fluid through the one side and through the opposite side.

17. A rotary pump or motor comprising: housing means defining a substantially cylindrical central cavity having a central axis and first and second ends;

a first and second stator, said first stator secured at said first end of said second stator secured at said second end of said central cylindrical cavity defined by said housing means, each said stator having a substantially circular cam surface including at least a pair of surface peaks circumferentially alternated with at least a pair of surface valleys, said first and second stators having their said respective cam surfaces opposed to one another and spaced apart on opposite sides of said central cavity defined within said housing means;

a substantially cylindrical rotor located within said central cylindrical cavity defined by said housing means and adjacent to and in contact with said first and second stators, said rotor having a length dimension, a central axis, an opening extending along said central axis, and a diameter such that it may be both rotated around and reciprocated along its said central axis within said central cylindrical cavity defined by said housing means between said stators, said rotor including first and second ends, said first and second ends each having a substantially circular cam surface including at least a pair of surface peaks circumferentially alternated with at least a pair of surface valleys and configured, when in a first position, for simultaneous substantial peak-to-valley mating engagement between said first rotor cam surface and said adjacent first stator cam surface so that no chamber is defined there-in-between, and substantial peak-to-peak mating engagement between said second rotor cam surface and said adjacent second stator cam surface so that a chamber is defined there-in-between, and when in a second position, for simultaneous substantial peak-to-valley mating engagement between said second rotor cam surface and said adjacent second stator cam surface so that no chamber is defined there-in-between, and substantial peak-to-peak mating engagement between said first rotor cam surface and said adjacent first stator cam surface so that a chamber is defined there-in-between, and when in neither the said first or the said second positions defining a variable chamber between said first and second rotor cam surface and said adjacent respective first and second stator cam surface;

a shaft, said shaft having a length dimension and located within said opening extending along said central axis of said rotor, said shaft connected to said rotor for rotation therewith while at the same time permitting reciprocating axial movement of said rotor along said shaft within said central cavity defined by said housing, said shaft also including means for attachment to said rotor to cause said rotor to rotate therewith while simultaneously allowing said rotor to freely move axially along said length of said shaft; whereby, during rotation said rotor can reciprocate along said shaft means between alternate first position mating engagement with each said first and second stator cam surface and positions defining a variable chamber between each said first and second rotor cam surface and said adjacent respective first and second stator cam surface;

port means in the form of a plurality of helical slots disposed in said housing means for controlling intake and discharge of fluid from said variable chambers defined between each said first and second rotor cam surface and said adjacent respective first and second stator cam surface on each side of said rotor; whereby further, said helical slots are so sized and shaped that when said rotor is rotated within said central cavity its said first and second rotor cam surface vary their contact with and spacing from said adjacent respective first and second stator cam surface and said rotor reciprocates thereby functioning as a rotary valve that opens and closes said helical slot ports, each said chamber being interconnected with a pair of helical slot ports spaced circumferentially adjacent each other and being of opposite hand with respect to each other for controlled intake and discharge of fluid from said helical slot port means.

18. The rotary pump or motor as claimed in claim 17, wherein the surface peaks and the surface valleys of each said first and second stator cam surface and each said first and second rotor end cam surface are spaced substantially equidistant about the circumference of each said stator cam surface and each said rotor end cam surface, respectively.

19. The rotary pump or motor as claimed in claim 17, wherein said stators are coaxial with one another.

20. The rotary pump or motor as claimed in claim 17, wherein said respective cam surfaces of said first and second oppositely secured stators are substantially mirror images of one another.

21. The rotary pump or motor as claimed in claim 17, wherein said rotor is of substantially uniform circumference and length.

22. The rotary pump or motor as claimed in claim 18, wherein said cam surfaces of said first and second stators and said cam surfaces of said first and second rotor are substantially normalized.

23. The rotary pump or motor as claimed in claim 22, wherein said substantially normalized surfaces of each cam surface are defined by planes extending through peripheral helical lines interconnecting said alternating peaks and valleys of the cam surface, said helical lines being of alternating opposite hands.

24. The rotary pump or motor as claimed in claim 17, wherein said shaft means comprises a single shaft aligned along said central axis of said cavity.

25. The rotary pump or motor as claimed in claim 24, wherein said opening extending along said axis of said rotor has at least one flat surface along the circumference thereof and said shaft is correspondingly shaped and includes attachment means including at least one flat surface along the perimeter thereof adapted for placement in said correspondingly shaped opening extending along said axis of said rotor.

26. The rotary pump or motor as claimed in claim 25, wherein said shaft has a polygonal-shaped perimeter, and said opening has a polygonal-shaped circumference.

27. The rotary pump or motor as claimed in claim 1, wherein the spacing between said stators and said length dimension of said rotor are sized such that when said first end face of said rotor is matingly engaged with said cam surface of said first stator adjacent thereto, said surface peaks of said second end face of said rotor abut said surface peaks of its opposed stator cam surface to form first and second chambers therebetween, and when said second end face is matingly engaged with said cam surface of said stator opposite thereof, said surface peaks of said first end face abut said surface peaks of its opposed stator cam surface to form third and fourth chambers therebetween.

28. The rotary pump or motor as claimed in claim 27, wherein said port means are sized and positioned so that as fluid enters said first and second chambers, fluid is simultaneously exited from said third and fourth chambers and that as fluid is enters said third and fourth chambers, fluid is simultaneously exited from said first and second chambers, in continuous alternating fashion so that as said rotor rotates in the presence of fluid, fluid is constantly entering into and simultaneously being discharged from said housing cavity.

29. The rotary pump or motor as claimed in claim 1, wherein said housing means further includes means disposed thereabout for directing all discharge fluid from discharge ports simultaneously through a single discharge member, and for likewise directing all inlet fluid to said inlet ports from a singular inlet source.

* * * * *